US007222898B1

(12) United States Patent
Mei

(10) Patent No.: US 7,222,898 B1
(45) Date of Patent: May 29, 2007

(54) CARPET KICKER

(76) Inventor: Tzu-Chiang Mei, 5th Floor, No. 28, Alley 401, Lane 150, Hsin I Road, Sec. 5, Taipei City (TW)

( * ) Notice: Subject to any disclaimer, the term of this patent is extended or adjusted under 35 U.S.C. 154(b) by 0 days.

(21) Appl. No.: 11/475,144

(22) Filed: Jun. 27, 2006

(51) Int. Cl.
*A47G 27/04* (2006.01)

(52) U.S. Cl. ..... 294/8.6; 254/205

(58) Field of Classification Search ..... 294/8.6; 254/200, 203, 205, 209
See application file for complete search history.

(56) References Cited

U.S. PATENT DOCUMENTS 670,947 A * 4/1901 Briggs ..... 254/205
1,929,837 A * 10/1933 Cathcard ..... 254/205
4,084,787 A * 4/1978 Kowalczyk ..... 254/201
5,626,329 A * 5/1997 Herdan ..... 254/200

* cited by examiner

*Primary Examiner*—Dean J. Kramer
(74) *Attorney, Agent, or Firm*—Rosenberg, Klein & Lee

(57) ABSTRACT

A carpet kicker includes a housing with a containing space, a front end and a rear end; a handle above the housing; a motive power device in the containing space, a motor supplying electric power and controlled by a switch and coupled to a reducer, a first gear at an output axle of the reducer, and a second gear driven by the first gear to rotate a second gear; a gear rack engaged with and driven by the second gear, and the front section of the gear rack being extended out from a front end of the housing; and a kicking unit coupled to a front end of the gear rack and linked by the gear rack, and a bottom surface of the kicking unit having a plurality of protruding pins for hooking a free end of the carpet to move it forward and spread the carpet.

4 Claims, 9 Drawing Sheets

CARPET KICKER

BACKGROUND OF THE INVENTION

1. Field of the Invention

The invention generally relates to a carpet kicker, and more particularly to a carpet kicker that can push a free end a carpet forward for the laying a carpet, such that the carpet can be pulled, spread and fixed smoothly on the floor.

2. Description of the Related Art

Carpets are commonly laid on the floor of our home or office and give us an indoor warm and comfortable feeling. However, carpets must be laid evenly and smoothly on the floor, or else the carpets will be uneven, not only affecting its appearance, but also creating a problem of stumbling people easily.

If a large carpet is laid, a user usually cannot pull and spread the thick and heavy carpet smoothly by hands, and thus a carpet kicker is needed for the job.

Referring to FIG. 1, a prior art carpet kicker 70 is used to hold a free end of a carpet 62 to push it towards a pin board 60 at a wall, and the carpet kicker 70 includes a rectangular main body 71, a kicking unit 72 installed at a front end of the main body 71, a plurality of protruding pins 73 disposed at the bottom surface of the kicking unit 72 for hooking and pulling the carpet 62. The height of the protruding pin 73 can be controlled by a knob 74. The main body 11 includes a cushion 75 disposed at an end of the main body 11, and carpet kickers of this sort are disclosed in U.S. Pat. No. 3,374,023.

When the carpet kicker 70 is in use, a user presses the main body 71 by hands, and pushes the cushion 75 in the arrowed direction by knees, such that the kicking unit 72 holds and moves the carpet 62 gradually towards a pin board 60 on a wall, and finally hooks an edge of the carpet 62 to a hook pin 61 of the pin board 60 to spread and fix the carpet 62. However, such method is time-consuming and laborious, and using knees to push the cushion 75 for a long time will become an issue of professional safety.

Referring to FIGS. 2 and 3 for another prior art carpet kicker 80, the carpet kicker 80 comprises an air pressure input end 81 connected to an air compressor 90 for providing air pressure to a housing 83 through a handle 82. The housing 83 includes a piston (not shown in the figure) for controlling a piston rod 85 to move forward and backward axially, and an external end of the piston rod 85 is connected to a hooking rod 86, and the bottom of the hooking rod 86 includes a hook 861. Further, a kicking unit 84 is installed at the bottom of a front end of the housing 83. Although the carpet kicker 80 intends to pull the carpet 62 pneumatically, its application still has the following problems:

1. Since the piston is driven pneumatically to move the piston rod 85, therefore an external air compressor 90 is needed to supply air pressure which is inconvenient to users. In other words, users have to carry a heavy and expensive air compressor 90 for the use of the carpet kicker 80, and it thus makes the application impractical.

2. Since the interval D between a pin board 60 for fixing the carpet 62 and a skirting board 64 at the wall is only 5 mm~10 mm, and the design does not allow the hook 861 to be installed within the interval D, and it often makes the carpet kicker 80 useless. If the interval D of the pin board 60 is increased to allow the installation of the hook 861, the carpet will produce creases easily and affect the appearance of the carpet adversely.

3. More importantly, the carpet kicker 80 uses the hooking rod 86 to hook a fixed end of the pin board 60, and then the piston board 85 is moved back and forth to pull components such as the housing 83, handle 82 and kicking unit 84 indicated by dotted lines in the figure to move towards the wall synchronously. Furthermore, the method of using the protruding pin 841 to drive and pull the carpet 62 towards the pin board 60 is not too practical, because all of the actions for hooking and pulling the carpet 62 are centralized at the hook 861, and the pin board 60 is lifted by the hook 861 when the carpet 62 has not been pulled evenly yet. Therefore, such method of pulling the carpet still has its inevitable drawbacks and requires further improvements.

SUMMARY OF THE INVENTION

Therefore, it is a primary object of the present invention to provide a carpet kicker, and the entire carpet kicker is fixed, and only a kicking unit holds and pushes a carpet towards a wall, so as to make the man-machine interface more convenient and achieve the effect of smoothly pulling and evenly spreading the carpet open quickly.

Another object of the present invention is to provide a carpet kicker that can be used as a standalone device or used together with several other carpet kickers, so that the carpet can be pushed and spread synchronously, so as to save construction time and achieve the effect of spreading the carpet more evenly and smoothly.

In order to achieve the above-mentioned objects, a carpet kicker includes:

a) a housing having a containing space, a front end, and a rear end;

b) a handle installed above the housing;

c) a motive power device installed in the containing space of the housing and having a motor for supplying electric power through an external power cable, the clockwise and counterclockwise rotations of the motor being controlled by a switch outside the housing, the motor being coupled to a reducer, a first gear being installed at an output axle of the reducer, a second gear being driven by the first gear to rotate a second gear in the housing;

d) a gear rack engaged with the second gear and driven by the second gear, a front section of the gear rack being extended out of a front end of the housing; and e) a kicking unit coupled to a front end of the gear rack and linked by the gear rack, a bottom surface of the kicking unit having a plurality of protruding pins for hooking and holding a free end of the carpet to move forward and pull and spread the carpet.

DETAILED DESCRIPTION OF THE PREFERRED EMBODIMENT

Figure 5:
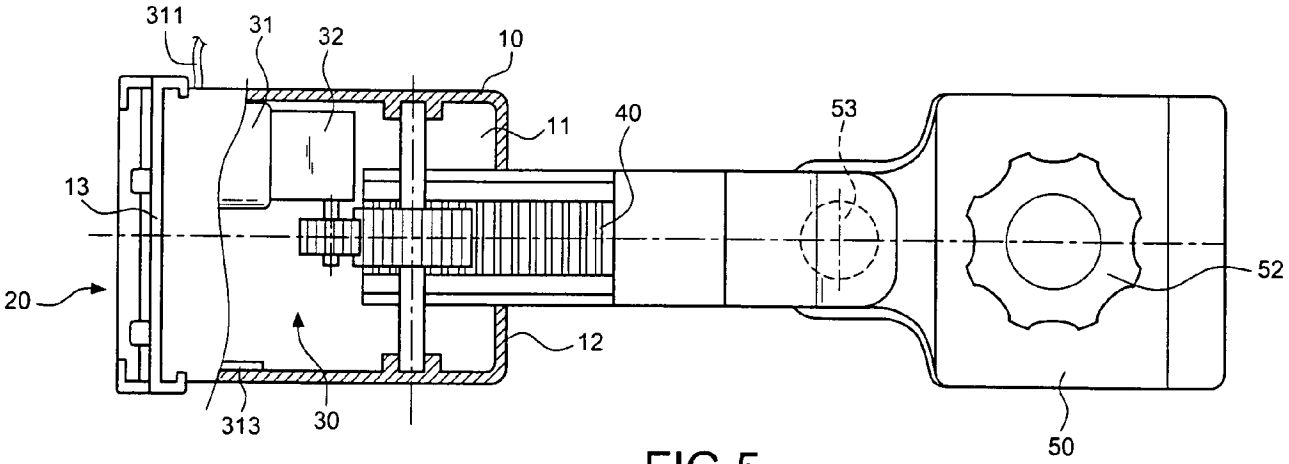
FIG. 5 is a cross-sectional view of a first preferred embodiment of the invention.
Figure 4:
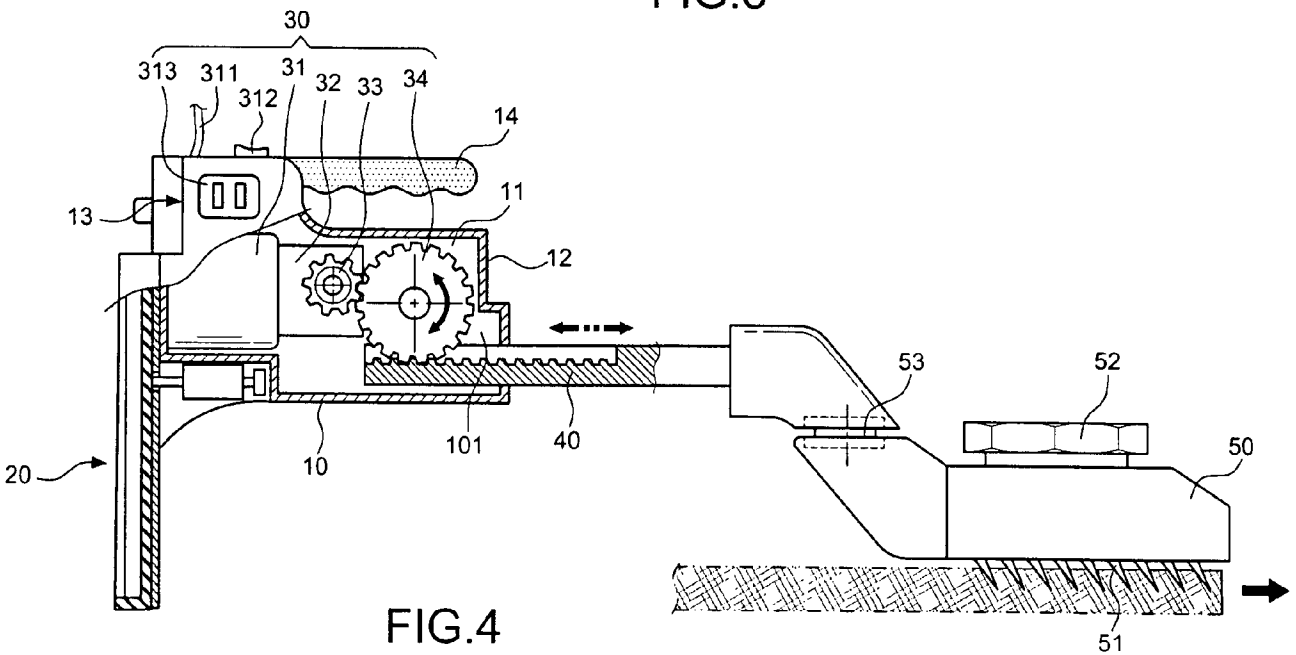
FIG. 4 is a side view of a first preferred embodiment of the invention.
Figure 6:
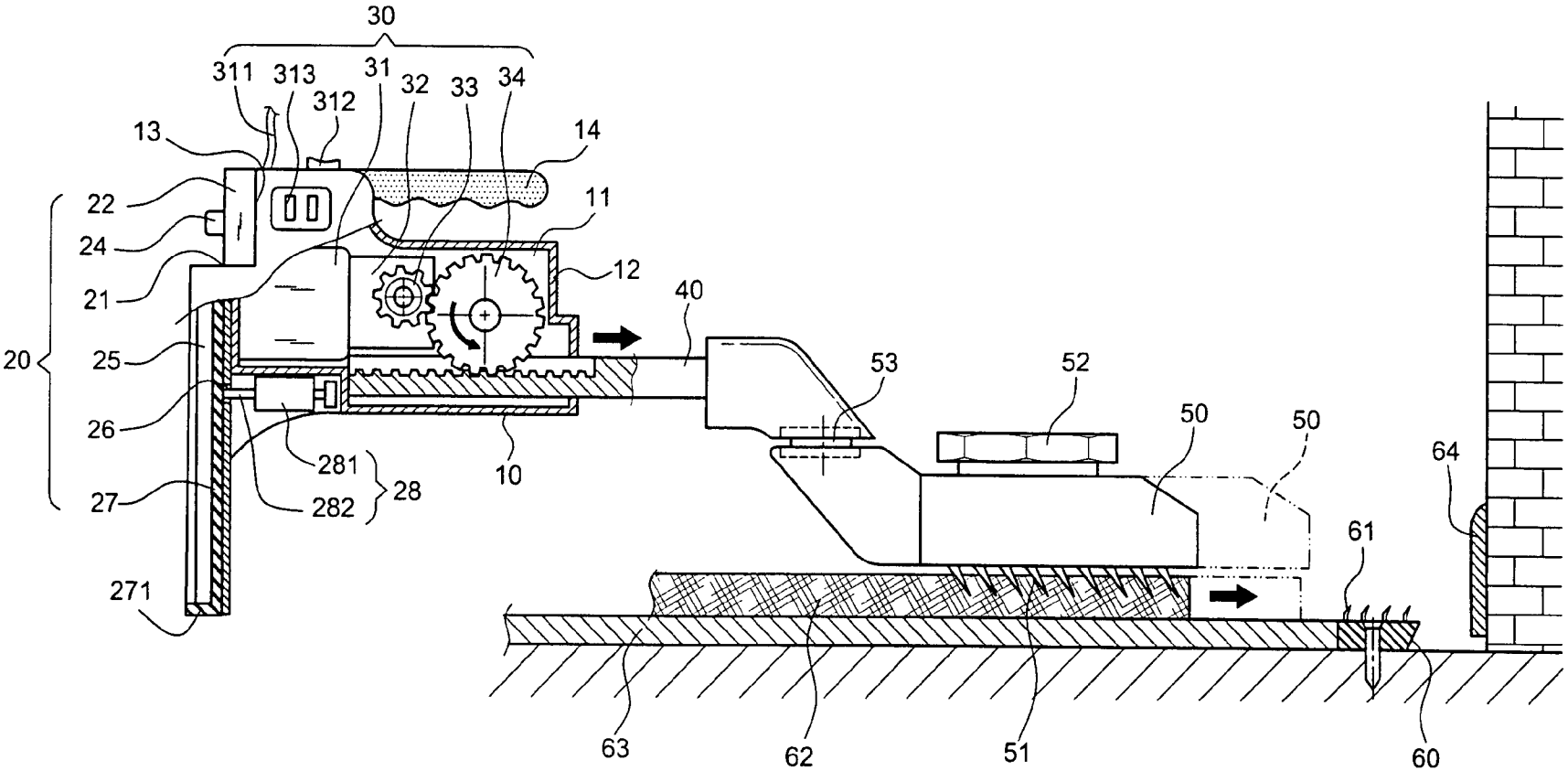
FIG. 6 is a schematic view of using a first preferred embodiment of the invention.

Referring to FIGS. 4 to 6, a first preferred embodiment of the present invention comprises:

a housing 10, having a containing space 11, a front end 12 and a rear end 13;

a handle 14, disposed above the housing 10 and provided for a user to hold;

a motive power device 30, installed in the containing space 11 of the housing 10 and including a motor 31, for supplying required electric power through an external power cable 311, and a switch 312 outside the housing 10 is used for controlling the clockwise and counterclockwise rotations or stop of the motive power device 30. In this preferred embodiment, the switch 312 is installed at a side of the handle 20 to facilitate users to control and operate the carpet kicker, but it is not limited to such position and any other appropriate position can serve the same purpose. Further, the motor 31 is connected to a reducer 32 for retarding the speed and increasing the output torque. A first gear 33 is installed at an output axle, and the first gear 33 drives a second gear 34 in the housing 10 to rotate. In this preferred embodiment, the first gear 33 is smaller than the second gear 34. Besides increasing the torque, such arrangement also prevents possible interference to the second gear 34 for driving a gear rack 40.

The gear rack 40 is engaged with the second gear 34 and driven by the second gear 34, and the front section of the gear rack 40 is extended out from the front end 12 of the housing 10. In other words, the gear rack 40 can be rotated by the second gear 34 to move back and forth linearly.

Further, a kicking unit 50 is connected to a front end of the gear rack 40 and moved with the gear rack 40, and the bottom surface has a plurality of protruding pins 51, and the height of the protruding pins 51 can be controlled by a knob 52, but it is a prior art, and thus its internal structure will not be described here.

From the imaginary lines indicated in FIG. 6, it is known that when the motor 31 is turned on, the first gear 33 and second gear 34 can drive the gear rack 40 to extend forward linearly and push the kicking unit 50 to move forward. When the gear rack 40 is extended and linked with the kicking unit 50 to move forward, the protruding pin 51 hooks a free end of the carpet 62 to be spread to the top of the pin board 60, and a hook pin 61 hooks the carpet 62 to complete the operation of spreading the carpet. Further, foam 63 is placed under the carpet 62 before the carpet is laid.

Figure 1:
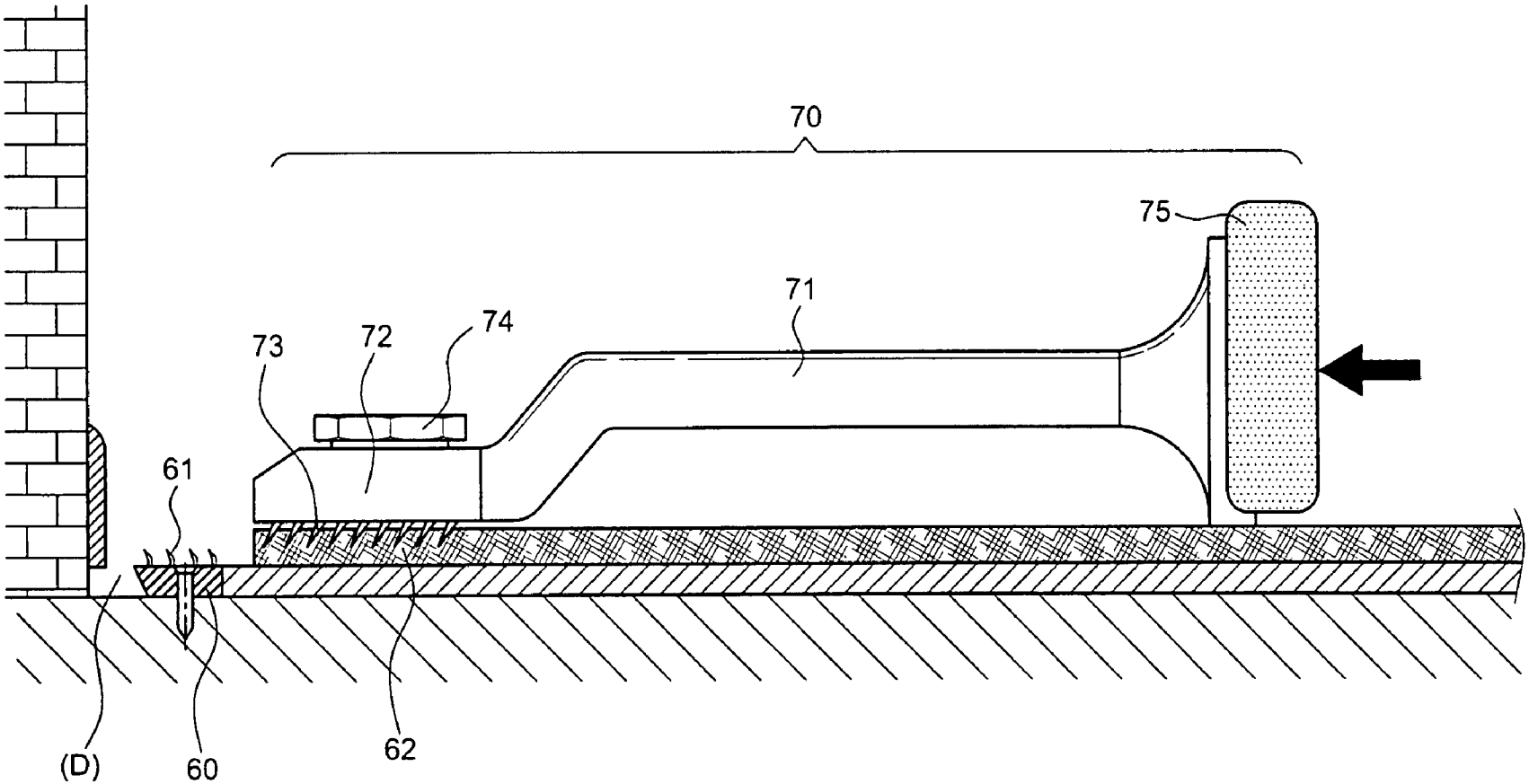
FIG.1 PRIOR ART
FIG. 1 is a schematic view of a prior art manual carpet kicker.
Figure 2:
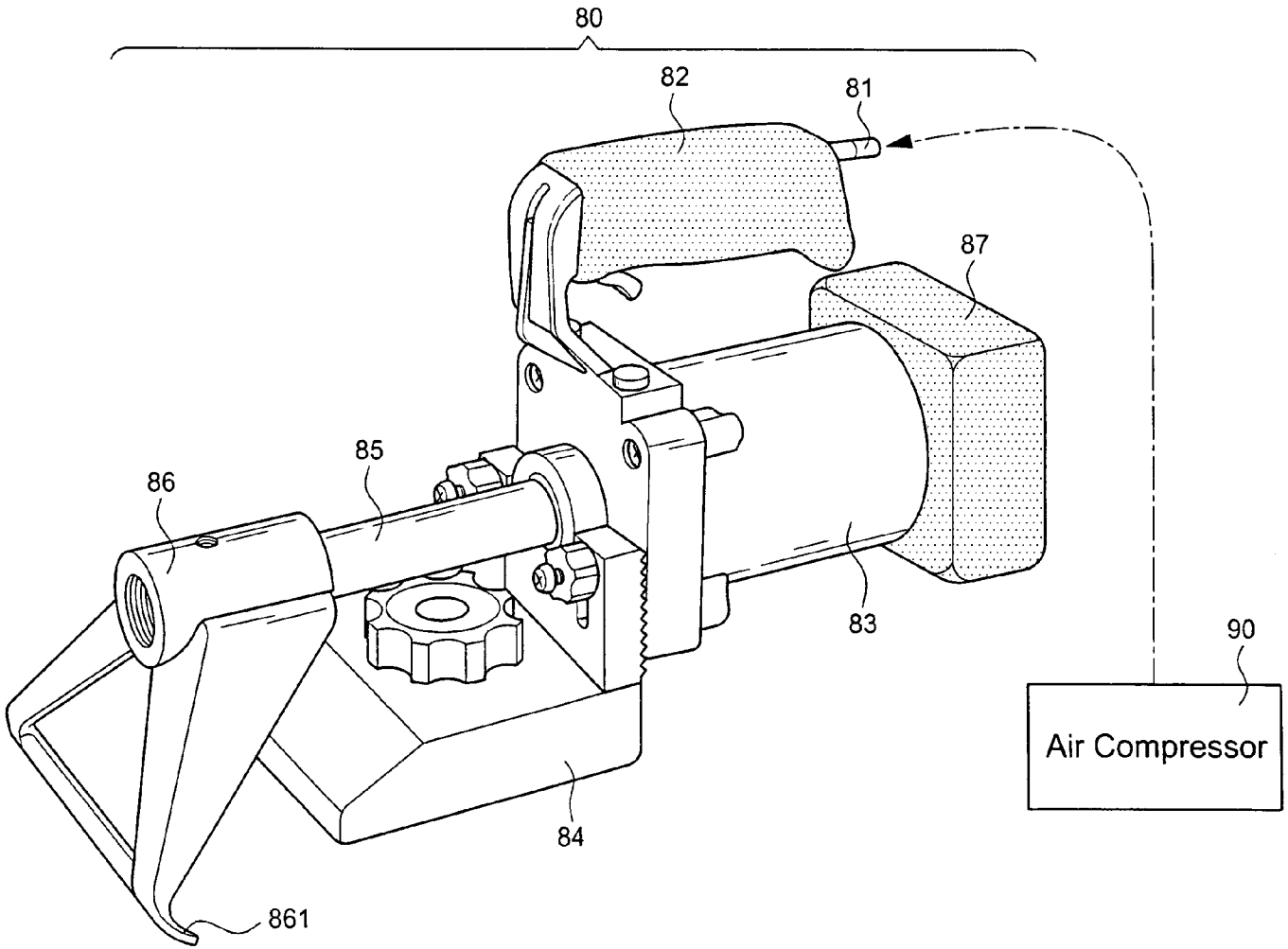
FIG.2 PRIOR ART
FIG. 2 is a perspective view of a prior art pneumatic carpet kicker.
Figure 3:
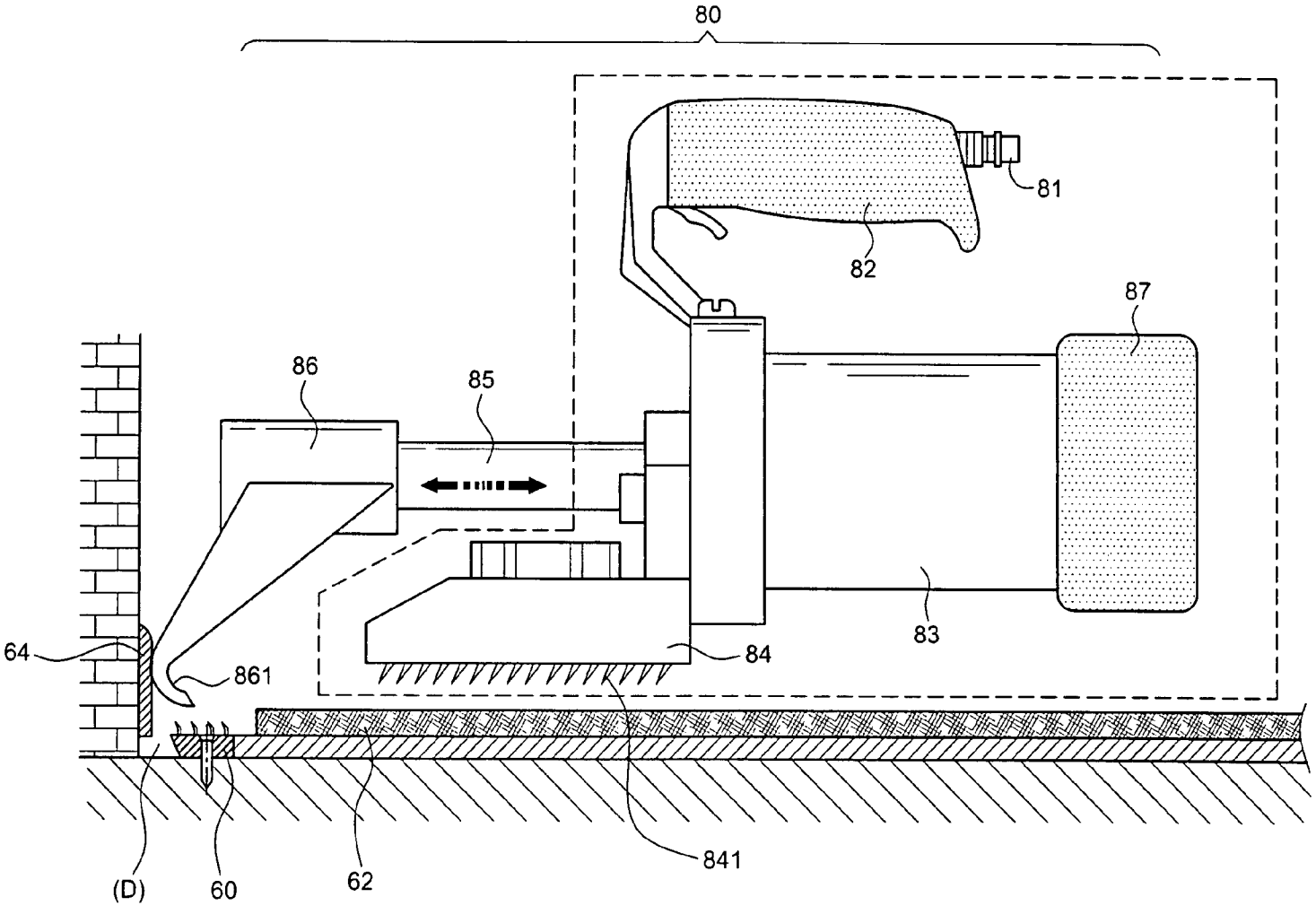
FIG.3 PRIOR ART
FIG. 3 is a schematic view of using a prior art pneumatic carpet kicker.

In the technical characteristics of the present invention, the motive power device 30 of the housing 10 pushes the kicking unit 50 forward to spread the carpet 62, and such operation is identical to the traditional method of using the whole carpet kicker to pull the carpet as shown in FIGS. 2 and 3. Further, the motive power device 30 of the invention only requires users to plug the external power cable 311 to an indoor power socket to obtain power supply without the need of using an air compressor as the power source. Further, an output power socket 313 is disposed at a lateral side of the housing 10 for supplying power to the next carpet kicker which is used simultaneously, and such arrangement makes the application more convenient and quicker.

Figure 7:
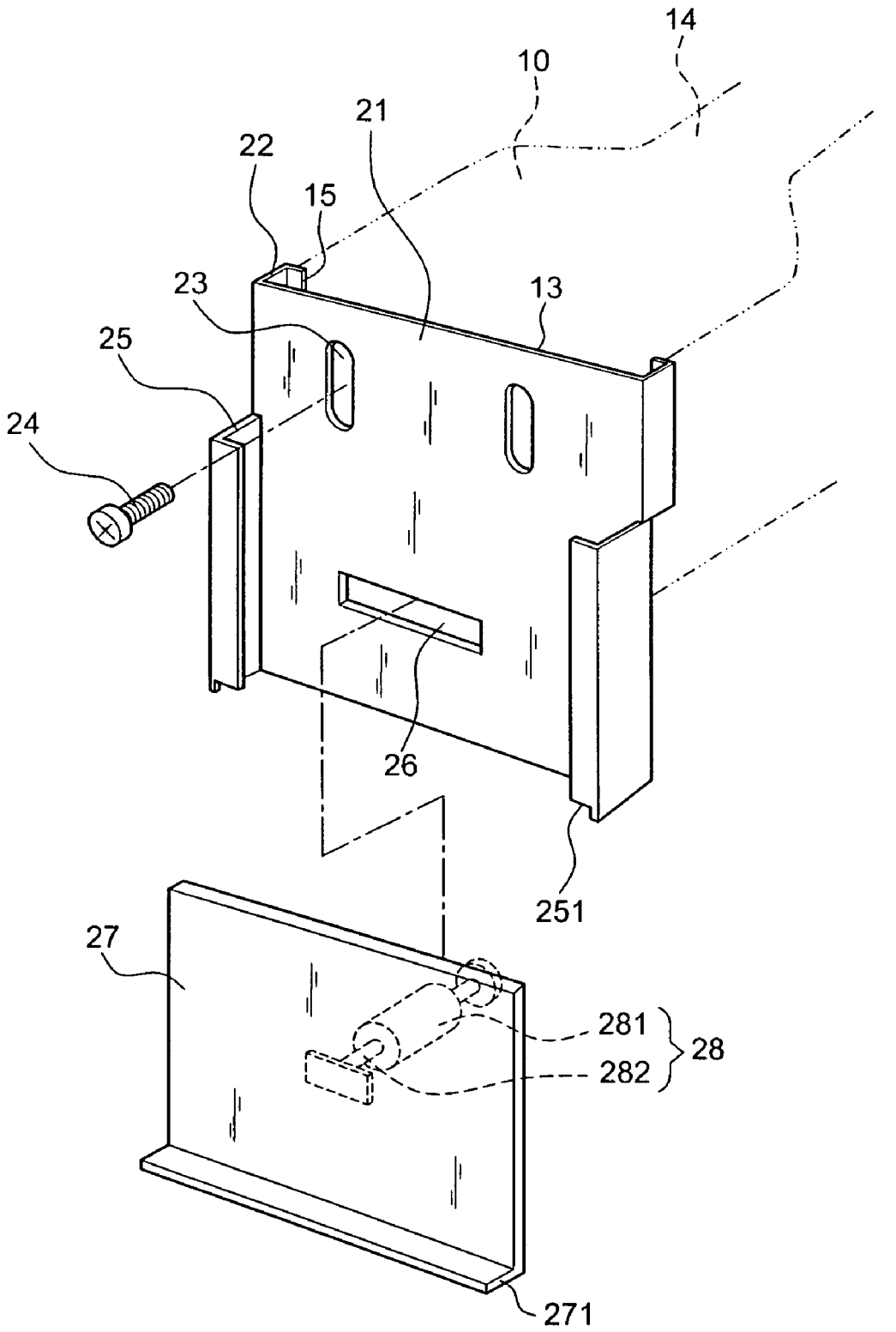
FIG. 7 is an exploded view of a positioning device of the present invention.

In the present invention, a rear end 13 of the housing 10 is coupled to a positioning device 20, and its detailed structure is illustrated by the exploded view as shown in FIG. 7. The structure comprises:

a connecting board 21, with its upper section facing a rear end 13 of the housing 10 and having a first latch groove 22 facing inward and disposed on both sides, two side grooves 15 embedded into the housing 10, at least one longitudinal hole 23 disposed at the upper end of the connecting board 21 and secured to the housing by a bolt 24, a second latch groove 25 facing outward and disposed at a lower end of the connecting board 21, and a transversal hole 26 disposed on the surface of the connecting board 21;

an L-shape board 27, installed in the second latch groove 25 and a horizontal short side 271 at the bottom of the L-shape board 27 being extended from a bottom surface 251 of the second latch groove 25; and a braking element 28, installed at a backside of the connecting board 21 and comprising a solenoid 281 and an adjustable rod 282, and an external end of the adjustable rod 282 being passed through a transversal hole 26 of the connecting board 21 and coupled to the L-shape board 27, and the solenoid 281 being operated for controlling the displacement of the L-shape board 27.

Figure 8:
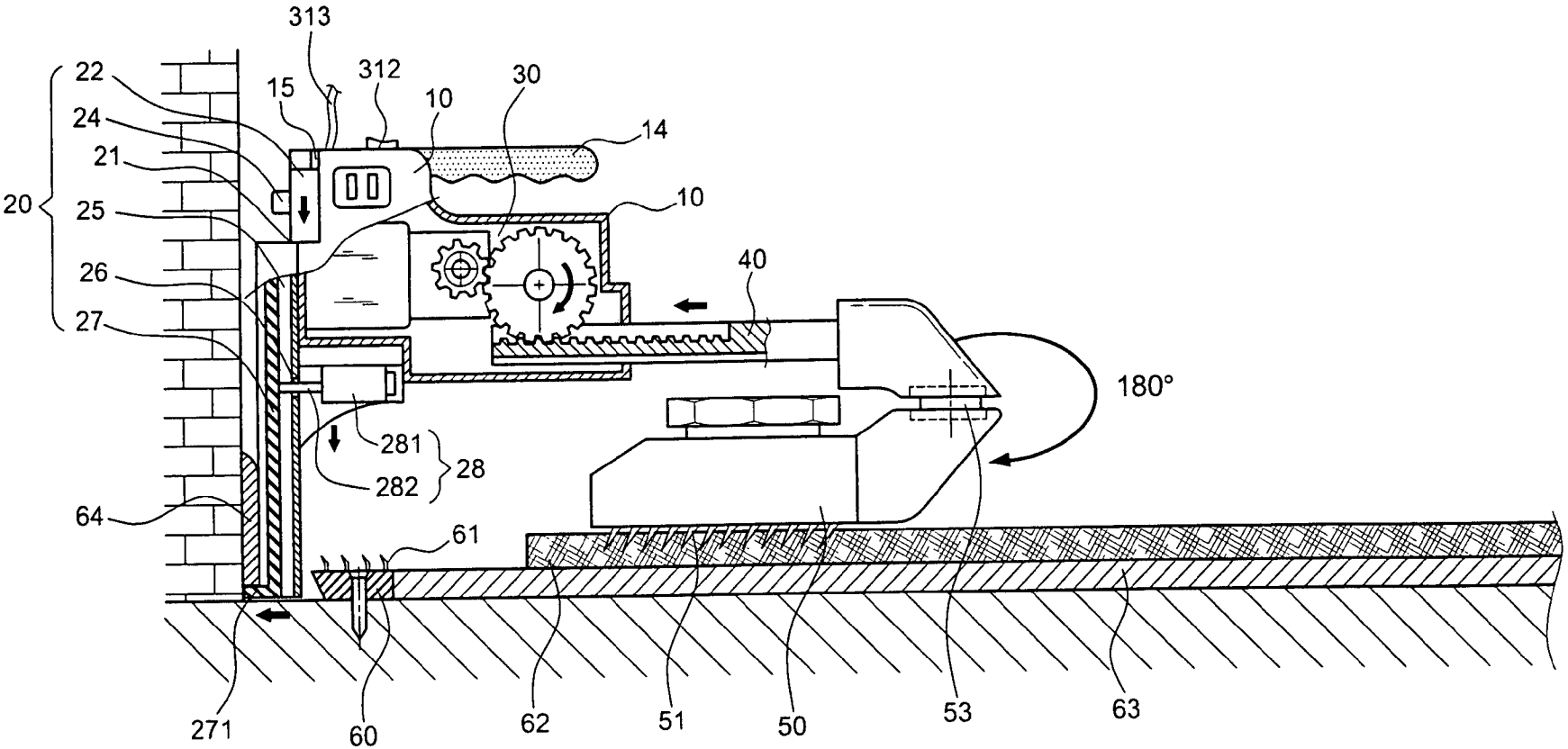
FIG. 8 is a cross-sectional side view of using a second preferred embodiment of the invention.
Figure 9:
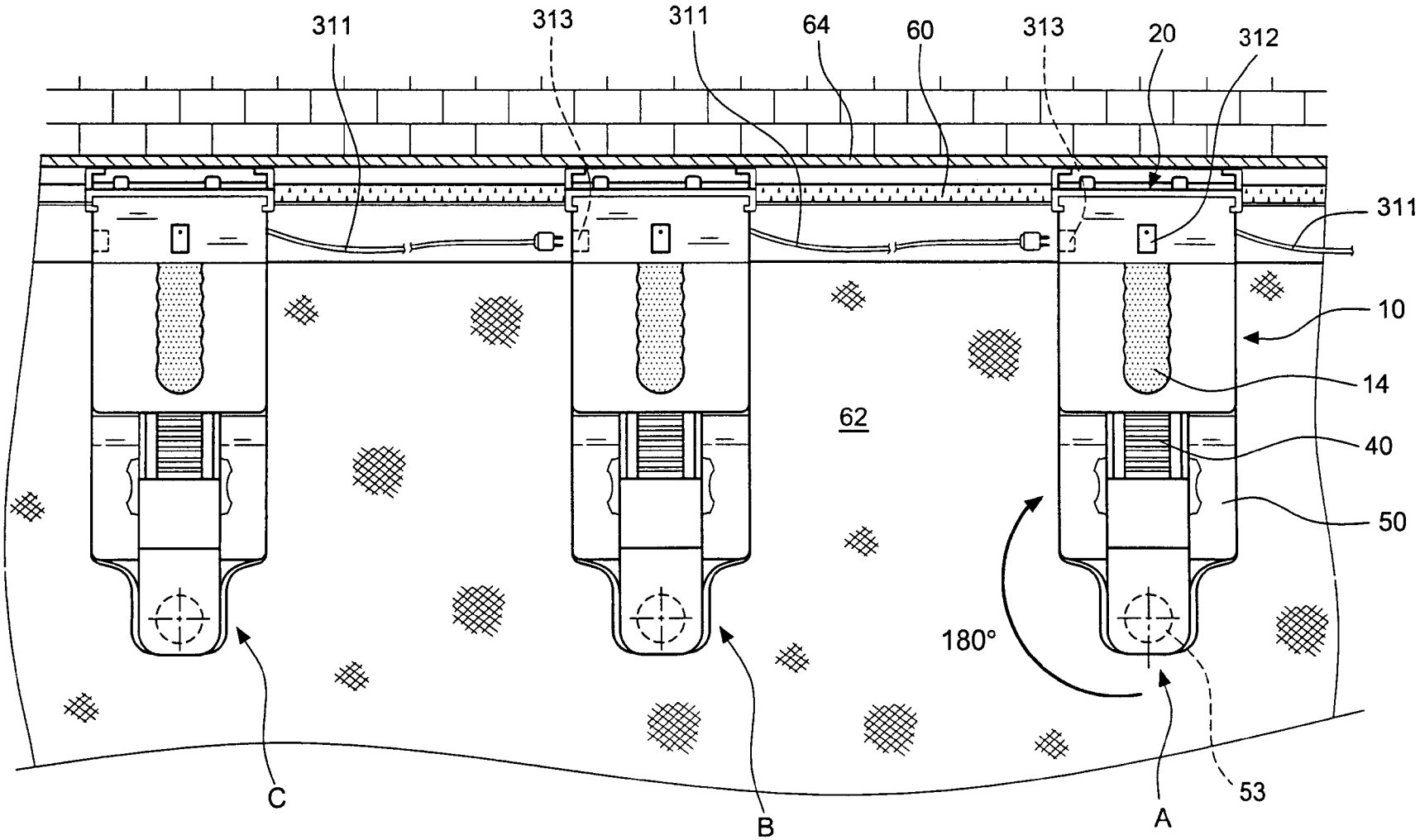
FIG. 9 is a top view of using a second preferred embodiment of the invention.

Referring to FIGS. 8 and 9 for the second preferred embodiment of the present invention, the foregoing assembly of the positioning device 20 rotates the kicking unit 50 at 180° backward by using the pivoting element 53 as an axis to loosens the bolt 24 to move the positioning device 20 downward to a specific height and uses the solenoid 281 of the braking element 28 for the operation, so as to push the adjustable rod 282 outward and drive the L-shape board 27 to move outward. The horizontal short side 271 at the bottom surface is hooked to the bottom of the skirting board 64 to fix the housing 10 without a deviation or an inclination. When the L-shape board 27 is positioned, the carpet kicker can be removed, and thus several carpet kickers can be used simultaneously as shown in FIG. 9. A user simply needs to operate the first carpet kicker (A) to control the second one (B), the third one (C) and so on. The external power cable 311 of a third carpet kicker (C) can be connected to the power socket 313 of the previous carpet kicker (B), (A) to serve as a master system of the first carpet kicker (A), and other kickers (B), (C) become subsystems operated in parallel to push the kicking unit 50 towards the pin board 60 and also spread the carpet 62. Such arrangement not only saves lots of time, but also provides the quality of an evener and smoother carpet and many advantages over the prior art that has to spread the carpet 62 piece by piece.

Figure 10:
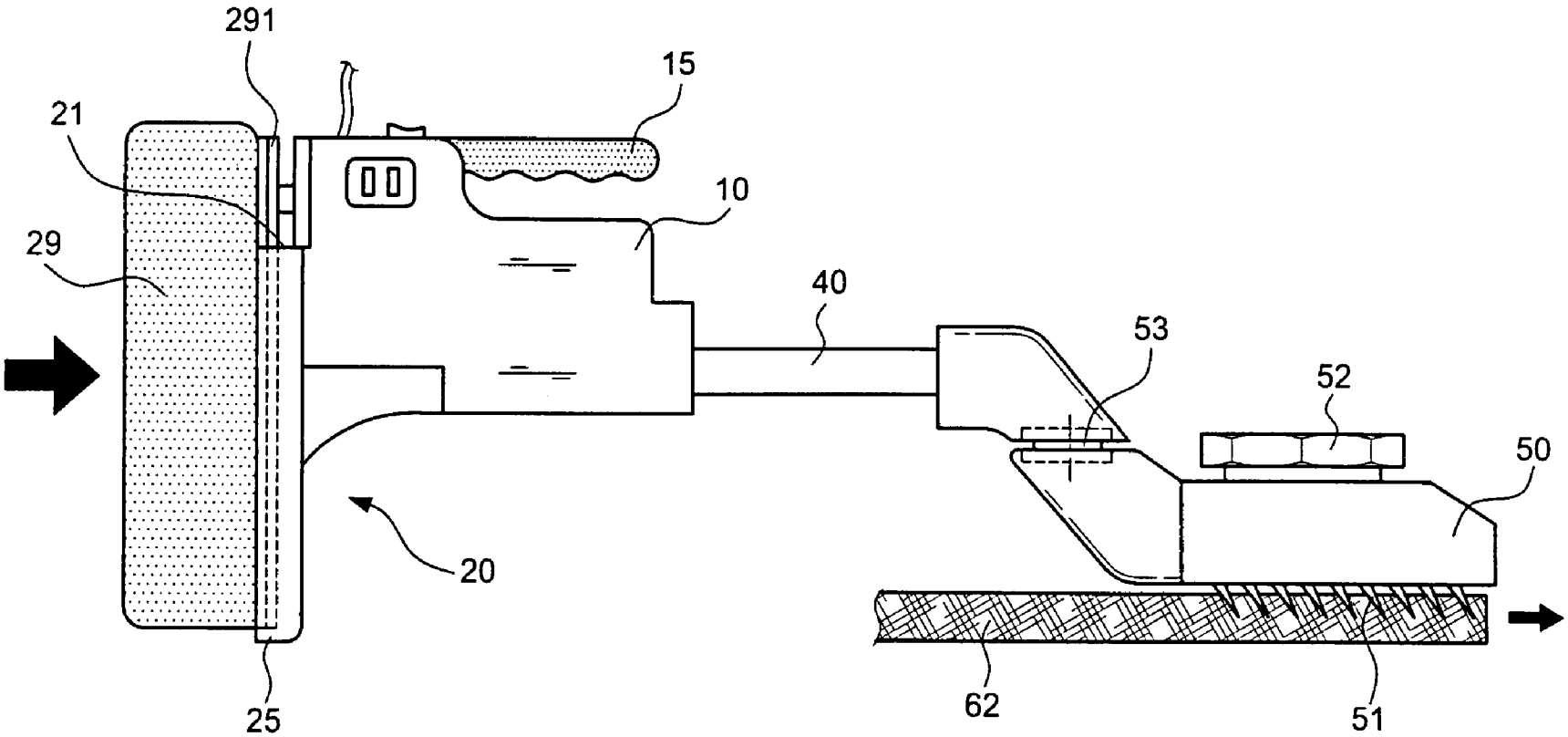
FIG. 10 is a side view of a third preferred embodiment of the invention.

Referring to FIG. 10 for a third preferred embodiment of the present invention, the second latch groove 25 of the connecting board 21 of the positioning device 20 is provided for embedding an internal latch board 291 of a cushion 29. A user can push the cushion 29 at the rear end of the housing 10 by knees in order to push the kicking unit 50 forward and drive the carpet 62 to move forward in the arrow direction. In the carpet kicker 80 as shown in FIGS. 2 and 3, the housing 83 and kicking unit 84 are pulled by the piston rod 85, and thus the user's knees cannot catch up with the operation to push the cushion 87. Compared with the prior art carpet kicker 80, the present invention is obviously more convenient and practical.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A carpet kicker, comprising:

a) a housing having a containing space, a front end, and a rear end;

b) a handle installed above the housing;

c) a motive power device installed in the containing space of the housing and having a motor for supplying electric power through an external power cable, the clockwise and counterclockwise rotations of the motor being controlled by a switch outside the housing, the motor being coupled to a reducer, a first gear being installed at an output axle of the reducer, a second gear being driven by the first gear to rotate a second gear in the housing;

d) a gear rack engaged with the second gear and driven by the second gear, a front section of the gear rack being extended out of a front end of the housing; and e) a kicking unit coupled to a front end of the gear rack and linked by the gear rack, a bottom surface of the kicking unit having a plurality of protruding pins for hooking and holding a free end of the carpet to move forward and pull and spread the carpet; and f) a pivoting element disposed at an end that connects the kicking unit and the gear rack and capable of rotating an angle of 180 degrees, such that the front end of the kicking unit can be rotated towards the rear end.

2. A carpet kicker comprising:

a) a housing having a containing space, a front end, and a rear end;

b) a handle installed above the housing;

c) a motive power device installed in the containing space of the housing and having a motor for supplying electric power through an external power cable, the clockwise and counterclockwise rotations of the motor being controlled by a switch outside the housing, the motor being coupled to a reducer, a first gear being installed at an output axle of the reducer, a second gear being driven by the first gear to rotate a second gear in the housing;

d) a gear rack engaged with the second gear and driven by the second gear, a front section of the gear rack being extended out of a front end of the housing; and e) a kicking unit coupled to a front end of the gear rack and linked by the gear rack, a bottom surface of the kicking unit having a plurality of protruding pins for hooking and holding a free end of the carpet to move forward and pull and spread the carpet;

wherein the housing includes a power socket disposed at a lateral side of the housing.

3. A carpet kicker comprising:

a housing having a containing space, a front end, and a rear end;

a handle installed above the housing;

a motive power device installed in the containing space of the housing and having a motor for supplying electric power through an external power cable, the clockwise and counterclockwise rotations of the motor being controlled by a switch outside the housing, the motor being coupled to a reducer, a first gear being installed at an output axle of the reducer, a second gear being driven by the first gear to rotate a second gear in the housing;

a gear rack engaged with the second gear and driven by the second gear, a front section of the gear rack being extended out of a front end of the housing;

a kicking unit coupled to a front end of the gear rack and linked by the gear rack, a bottom surface of the kicking unit having a plurality of protruding pins for hooking and holding a free end of the carpet to move forward and pull and spread the carpet; and, a positioning device that includes:

a) a connecting board with its upper section facing a rear end of the housing and having a first latch groove facing inward and disposed on both sides, two side grooves being embedded into the housing, at least one longitudinal hole being disposed at the upper end of the connecting board and secured to the housing by a bolt, a second latch groove facing outward and disposed at a lower end of the connecting board, a transversal hole being disposed on the surface of the connecting board;

b) an L-shape board installed in the second latch groove and a horizontal short side at the bottom of the L-shape board being extended from a bottom surface of the second latch groove; and c) a braking element installed at a backside of the connecting board and including a solenoid and an adjustable rod, an external end of the adjustable rod being passed through a transversal hole of the connecting board and coupled to the L-shape board, the solenoid being operated for controlling the displacement of the L-shape board.

4. The carpet kicker as recited in claim 3, wherein the second latch groove of the connecting board is provided for embedding an internal latch board of a cushion.

* * * * *